US011085193B2

(12) United States Patent
Cataldi et al.

(10) Patent No.: US 11,085,193 B2
(45) Date of Patent: Aug. 10, 2021

(54) PERIPHERAL RESTRAINT SYSTEM FOR ELEVATED FLOORING SURFACE

(71) Applicant: United Construction Products, Inc., Denver, CO (US)

(72) Inventors: Francesco Cataldi, Miami, FL (US); Will Heimbuch, Denver, CO (US); Matthew McClaugherty, Evergreen, CO (US)

(73) Assignee: United Construction Products, Inc., Denver, CO (US)

( * ) Notice: Subject to any disclaimer, the term of this patent is extended or adjusted under 35 U.S.C. 154(b) by 60 days.

(21) Appl. No.: 16/353,812

(22) Filed: Mar. 14, 2019

(65) Prior Publication Data

US 2019/0309528 A1 Oct. 10, 2019

Related U.S. Application Data

(60) Provisional application No. 62/654,593, filed on Apr. 9, 2018.

(51) Int. Cl.
*E04F 15/024* (2006.01)

(52) U.S. Cl.
CPC .. *E04F 15/02452* (2013.01); *E04F 15/02458* (2013.01)

(58) Field of Classification Search
CPC ..... E04F 15/02452; E04F 15/02458
USPC ..... 52/126.6
See application file for complete search history.

(56) References Cited

U.S. PATENT DOCUMENTS

| | | | | | |
|---|---|---|---|---|---|
| 2,703,002 | A | | 3/1955 | Suskind | |
| 2,956,652 | A | | 10/1960 | Liskey | |
| 2,956,653 | A | * | 10/1960 | Liskey, Jr. | E04F 15/02405 52/396.06 |
| 3,045,294 | A | | 7/1962 | Livezky | |
| 3,065,506 | A | * | 11/1962 | Tremer | E04F 15/02458 52/126.6 |
| 3,150,748 | A | * | 9/1964 | Liskey, Jr. | E04F 15/02405 52/396.04 |
| 3,180,460 | A | * | 4/1965 | Liskey, Jr. | E04F 15/02452 52/479 |

(Continued)

FOREIGN PATENT DOCUMENTS

JP H10231661 9/1988

*Primary Examiner* — Brian E Glessner
*Assistant Examiner* — James J Buckle, Jr.
(74) *Attorney, Agent, or Firm* — Holzer Patel Drennan

(57) ABSTRACT

A peripheral stabilizing system for elevated flooring surfaces that is configured to resist uplift forces acting against the elevated flooring surface thereby reducing the likelihood of dislodged flooring units (e.g., surface tiles, pavers, etc.) and the like. Broadly, the disclosed system includes a support structure disposed over a fixed surface (e.g., roof deck or the like), a plurality of flooring units appropriately laid over the support structure, and one or more restraint systems positionable adjacent the outer periphery of the flooring surface. Each restraint system includes an anchoring member disposed over the outer periphery and a wedge member insertable between the anchoring member and the wall to frictionally grip the anchoring member and wall and thereby restrict movement of at least one of the peripheral flooring units in a direction away from the fixed surface.

20 Claims, 13 Drawing Sheets

(56) References Cited

U.S. PATENT DOCUMENTS 3,236,018 A * 2/1966 Graham ..... B62D 33/048 52/791.1
3,318,057 A * 5/1967 Norsworthy ..... E04F 15/02482 52/126.6
3,422,584 A 1/1969 Howard
3,449,873 A 6/1969 Zittler
3,464,177 A 9/1969 Amato
3,606,714 A 9/1971 Arnett
3,759,005 A * 9/1973 Smith ..... E04B 1/6807 52/396.04
3,831,334 A 8/1974 Rutkowski
4,004,381 A 1/1977 Pichler et al.
4,204,376 A 5/1980 Calvert
4,295,319 A * 10/1981 Griffin ..... E04F 15/02435 52/783.1
4,319,520 A 3/1982 Lanting et al.
4,565,041 A 1/1986 Wendt
4,656,795 A * 4/1987 Albrecht ..... E04F 15/02435 52/126.6
4,942,708 A * 7/1990 Krumholz ..... E04F 15/024 52/126.6
5,184,445 A 2/1993 Hoopengardner
5,203,640 A 4/1993 Pourtau et al.
5,265,386 A * 11/1993 Muhlethaler ..... E04F 15/024 52/126.6
5,442,882 A * 8/1995 Repasky ..... E04D 11/007 248/188.4
5,444,954 A 8/1995 Anderson
5,501,754 A * 3/1996 Hiraguri ..... E04F 15/02476 156/71
5,588,264 A * 12/1996 Buzon ..... E04D 11/007 108/150
5,598,681 A 2/1997 DiGianni
5,904,009 A * 5/1999 Huang ..... E04F 15/02458 52/126.4
6,101,775 A 8/2000 Larimore
6,282,855 B1 9/2001 Shipton
6,363,685 B1 * 4/2002 Kugler ..... E04F 15/02183 52/126.6
6,725,614 B2 4/2004 Schiedegger et al.
6,786,016 B1 9/2004 Wood
6,804,923 B1 10/2004 Potter
7,140,156 B1 11/2006 Lowe, Jr. et al.
7,360,343 B1 4/2008 Spransy et al.
7,703,249 B2 4/2010 Rachak
8,381,461 B2 * 2/2013 Repasky ..... E04F 15/02183 52/126.6
8,898,999 B1 12/2014 Kugler et al.
8,955,263 B2 2/2015 Hatzinikolas
9,790,690 B2 * 10/2017 Kugler ..... E04F 15/024
10,113,320 B1 * 10/2018 Cataldi ..... E04F 15/02464
2004/0050009 A1 3/2004 Fuhr
2005/0189723 A1 9/2005 Chassee
2005/0284040 A1 12/2005 Hashimoto
2006/0080939 A1 4/2006 Bledsoe et al.
2006/0130416 A1 6/2006 Mohr et al.
2009/0056235 A1 3/2009 Morsching
2009/0084046 A1 * 4/2009 McConnell ..... E04F 15/02429 52/126.6
2009/0199494 A1 * 8/2009 Lee ..... B25B 23/00 52/126.6
2011/0163510 A1 * 7/2011 Wedi ..... E04F 19/061 277/644
2012/0036796 A1 2/2012 Camilli
2012/0272588 A1 * 11/2012 Kugler ..... E04F 15/0247 52/126.6
2012/0272589 A1 * 11/2012 Kugler ..... E04F 15/02183 52/126.6
2013/0219809 A1 * 8/2013 Tabibnia ..... E04F 15/02482 52/126.6
2014/0123576 A1 5/2014 Meyer
2014/0237912 A1 * 8/2014 Kugler ..... E04F 15/02464 52/126.6
2016/0040439 A1 * 2/2016 Pelc ..... E04F 15/0247 52/126.6
2017/0152635 A1 * 6/2017 Tabibnia ..... E04F 15/02476
2018/0038117 A1 * 2/2018 Bordin ..... E04F 15/02458
2019/0368203 A1 * 12/2019 Bordin ..... E04F 15/02452

* cited by examiner

PERIPHERAL RESTRAINT SYSTEM FOR ELEVATED FLOORING SURFACE

CROSS REFERENCE TO RELATED APPLICATION

This application claims the benefit of U.S. App. No. 62/654,593, entitled "PERIPHERAL RESTRAINT SYSTEM FOR ELEVATED FLOORING SURFACE," and filed on Apr. 9, 2018, the entire contents of which are incorporated herein by reference as if set forth in full.

BACKGROUND OF THE INVENTION

1. Field of the Invention

This invention relates to the field of support structures for supporting and restraining an elevated surface above a fixed surface, such as support structures to elevate surface tiles for elevated floors, decks and walkways.

2. Description of Related Art

Elevated building surfaces such as elevated floors, decks, terraces and walkways are desirable in many interior and exterior environments. One common system for creating such surfaces includes a plurality of surface tiles, such as concrete tiles (pavers), stone tiles, clay tiles, ceramic tiles, or wood tiles, and a plurality of spaced-apart support pedestals and/or joists or stringers upon which the tiles are placed to be supported above a fixed surface. For example, in outdoor applications, the surface may be elevated above a fixed surface to promote drainage, to provide a level structural surface for walking, and/or to prevent deterioration of or damage to the surface tiles.

Various shapes of surface tiles are possible. In the case of rectangular-shaped tiles, for instance, each of the spaced-apart support pedestals can support four adjacent surface tiles at the tile corners. Stated another way, each rectangular surface tile can be supported by four pedestals that are disposed under each of the corners of the tile.

The pedestals can have a fixed height or can have an adjustable height such as to accommodate variations in the contour of the fixed surface upon which the pedestals are placed or to create desirable architectural features. Various types of support pedestals are disclosed in U.S. Pat. No. 6,363,685 to Kugler, U.S. Patent Publication No. 2004/0261329 to Kugler et al., U.S. Pat. No. 8,122,612 to Knight, III et al., and U.S. Pat. No. 8,898,999 to Kugler et al., each of which is incorporated herein by reference in its entirety. For instance, some types of support pedestals include a threaded base member and a threaded support member that is threadably engaged with the base member to enable the height of the support pedestal to be adjusted by rotating the support member or the base member relative to the other. Support pedestals can also include an extender member (e.g., a coupling or coupler member) disposed between the base member and the support member for further increasing the height of the pedestal, if necessary.

SUMMARY OF THE INVENTION

One problem associated with some support structures for elevated surfaces is that the flooring units (e.g., surface tiles, pavers, building surface components, etc.) making up the elevated surfaces are sometimes susceptible to movement due to pressure differences above and below the flooring units, such as from strong winds blowing across the flooring units. More specifically, wind can sometimes generate uplift forces, particularly around a perimeter of an elevated building surface, that can dislodge flooring units and thereby require subsequent repair. For instance, elevated building surfaces are sometimes built on fixed surfaces, where a support structure in the form of a plurality of support pedestals is arranged over the fixed surface and a plurality of flooring units are appropriately placed over the support pedestals that collectively form the elevated surface. Furthermore, one or more walls (e.g., parapets, curbs, etc.) often extend upwardly from the fixed surface around and adjacent an outer periphery of the elevated surface. In the case of a building roof, a support structure and flooring units are sometimes disposed over the roof deck and a parapet may extend upwardly away from the roof deck and surround the flooring units.

In any event, uplift forces from wind can push against the bottom surfaces of the flooring units adjacent the parapet and lift such tiles upwardly off of the support structure (e.g., support pedestals). In some situations, uplift forces can be greatest near the corners of the elevated building surface (e.g., where adjacent parapet sections meet) and can dislodge flooring units which may eventually lead to displacement or buckling of other flooring units. Furthermore, some counties and other jurisdictions have building codes specifying that elevated surface support structures must be able to withstand high winds.

In view of the foregoing, disclosed herein is a peripheral stabilizing system for elevated flooring surfaces that is configured to resist uplift forces acting against the bottom of the elevated flooring surface adjacent an outer periphery of the elevated flooring surface and thereby reduce the likelihood of dislodged flooring units. Broadly, the disclosed system includes a support structure (e.g., support pedestals, joists, etc.) disposed over a fixed surface (e.g., roof deck or the like), a plurality of flooring units appropriately laid over the support structure, and one or more restraint systems positionable adjacent the outer periphery of the flooring surface. Each restraint system may include an anchoring member disposed over the outer periphery and a wedge member insertable between the anchoring member and the wall to frictionally grip the anchoring member and wall and thereby restrict movement of at least one of the peripheral flooring units in a direction away from the fixed surface.

In one aspect, an elevated flooring surface assembly includes a plurality of support apparatuses spacedly disposed upon a fixed surface, a plurality of building surface components disposed over upper surfaces of the support apparatuses to create an elevated flooring surface, and a restraint system positionable between the outer periphery of the elevated building surface and the wall. The building surface components include interior building surface components and peripheral building surface components disposable between the interior building surface components and a wall, where outer edge segments of the peripheral building surface components collectively form an outer periphery of the elevated building surface. Furthermore, the restraint system includes an anchoring member disposed over the outer periphery, and a wedge member insertable between the anchoring member and the wall to frictionally grip the anchoring member and wall and thereby restrict movement of at least one of the peripheral building surface components in a direction away from the fixed surface.

In another aspect, a method of stabilizing a flooring surface that is elevated over a fixed surface by a support structure adjacent a wall extending from the fixed surface is disclosed, where the method includes wedging a restraint member between the wall and an outer periphery of the flooring surface to restrict movement of the flooring surface in a direction away from the fixed surface.

In a further aspect, a method of constructing an elevated flooring surface is disclosed, where the method includes locating a plurality of support pedestals upon a fixed surface that is at least partially surrounded by a wall, where each support pedestal includes a base member, a support member, and a central section interconnecting the base and support members, and where the support member includes an upper surface; placing flooring units over the upper surfaces of the support members of the support pedestals to create an elevated building surface of the building surface assembly, where the flooring units include interior flooring units and peripheral flooring units disposed between the interior flooring units and the wall, where outer edge segments of the peripheral flooring units collectively form an outer periphery of the elevated building surface; and wedging a restraint member between the wall and an outer periphery of the flooring surface to restrict movement of the peripheral flooring units in a direction away from the fixed surface.

Any of the embodiments, arrangements, or the like discussed herein may be used (either alone or in combination with other embodiments, arrangement, or the like) with any of the disclosed aspects. Merely introducing a feature in accordance with commonly accepted antecedent basis practice does not limit the corresponding feature to the singular. Any failure to use phrases such as "at least one" does not limit the corresponding feature to the singular. Use of the phrase "at least generally," "at least partially," "substantially" or the like in relation to a particular feature encompasses the corresponding characteristic and insubstantial variations thereof. Furthermore, a reference of a feature in conjunction with the phrase "in one embodiment" does not limit the use of the feature to a single embodiment.

In addition to the exemplary aspects and embodiments described above, further aspects and embodiments will become apparent by reference to the drawings and by study of the following descriptions.

DESCRIPTION OF THE INVENTION

Figure 1:
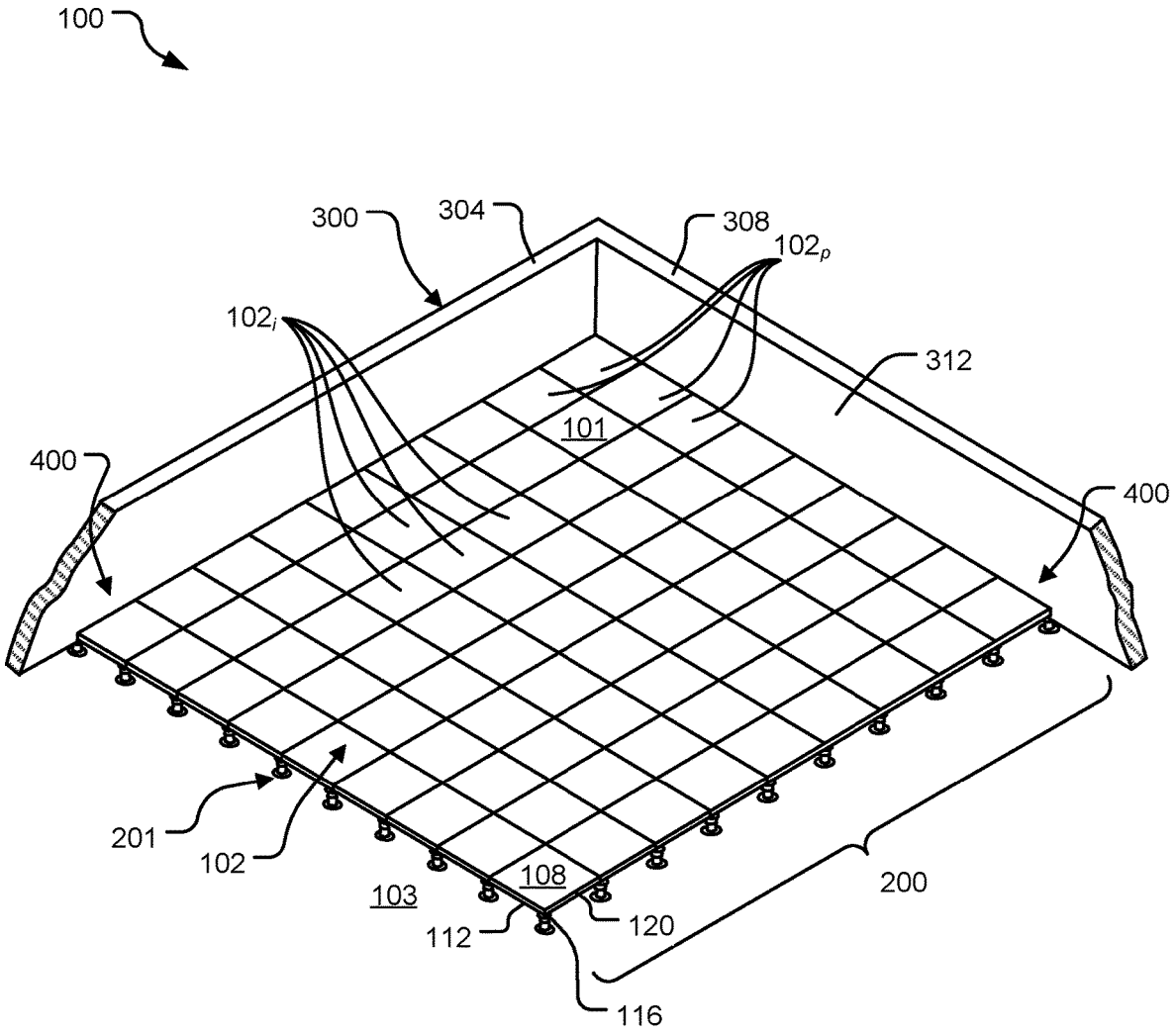
FIG. 1 is a perspective view of an elevated building surface assembly partially surrounded by a wall according to an embodiment.

FIG. 1 illustrates a portion of an elevated building surface assembly 100 according to one embodiment that includes an elevated building surface 101 formed from a plurality of flooring units 102 (e.g., building surface components, surface tiles, pavers, etc.) that are elevated above a fixed surface 103 by a support structure 200. Each flooring unit 102 may broadly include generally opposing top and bottom surfaces 108, 112, one or more corner portions 116, and one or more outer edge segments 120 disposed between adjacent corner portions 116. The flooring units 102 can be made of virtually any appropriate material(s) such as slate, natural stone, concrete (e.g., pavers), wood, metal, fiberglass, rubber, various composites, ceramic, plastics, synthetics, and the like.

At least one wall 300 (e.g., parapet, curb, etc.) may extend upwardly away from the fixed surface 103 (e.g., such as the roof of a building) and generally surround at least a portion of the elevated building surface assembly 100. For instance, the wall 300 may have one or more wall sections such as first and second wall sections 304, 308. As shown, the flooring units 102 may generally include interior flooring units $\mathbf{102}_i$ and peripheral flooring units $\mathbf{102}_p$ disposed between the interior flooring units $\mathbf{102}_i$ and an inner surface 312 of the wall 300, where outer edge segments 120 of the peripheral flooring units $\mathbf{102}_p$ collectively define an outer periphery of the elevated building surface 101.

The bottom surfaces 112 of the corner portions 116 of the flooring units 102 may be placed upon several support pedestals 201 arranged in any appropriate configuration (e.g., rows and columns) to elevate the flooring units 102 above the fixed surface 103 (i.e., so that a gap or distance exists between the bottom surfaces 112 of the flooring units 102 and the fixed surface 103). For instance, some support pedestals 201 may be disposed beneath four corner portions 116 of adjacent flooring units 102 while other support pedestals 201 may be disposed under the outer edge segments 120 of the flooring units 102 (e.g., between the corner portions 116 and proximate to a central portion of the outer edge segment 120). Although not illustrated, support pedestals 201 may be disposed in other locations, such as below a central portion of the flooring units 102.

The support pedestals 201 forming the support structure 200 may be height-adjustable, fixed height, or any combination thereof and may be constructed of any appropriate materials (e.g., metals, plastics, carbon fibers, composites, etc.). Broadly, each support pedestal 201 may include a lower portion that is adapted to be placed upon a fixed surface, an upper portion for receiving a flooring unit 102, and a central section extending between or otherwise interconnecting (e.g., perpendicularly) the upper and lower portions. The support pedestals 201 may be laid out in various configurations as may be dictated by the shape and size of the building surface components, such as a rectangular configuration or a triangular configuration to support rectangular or triangular building surface components.

Figure 2:
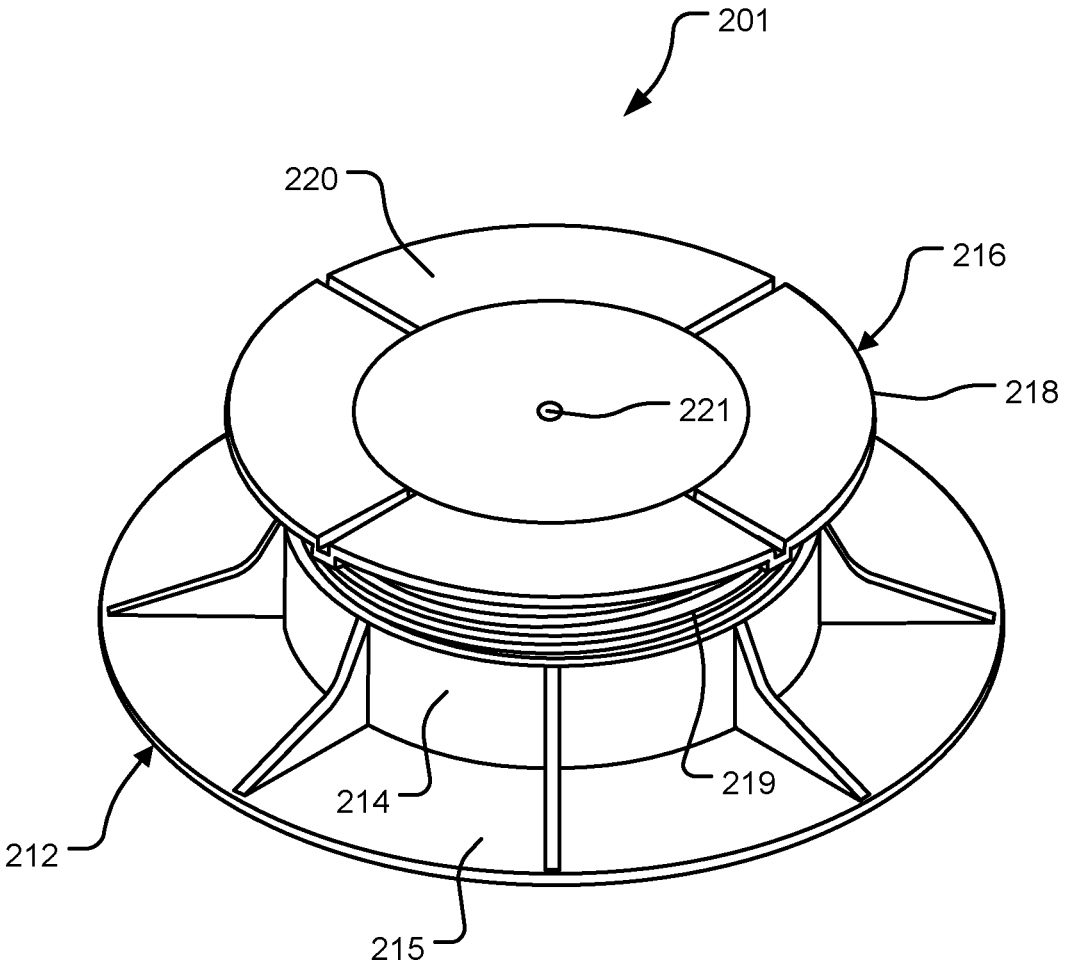
FIG. 2 is a perspective view of a support pedestal for use with the surface assembly of FIG. 1.
Figure 3:
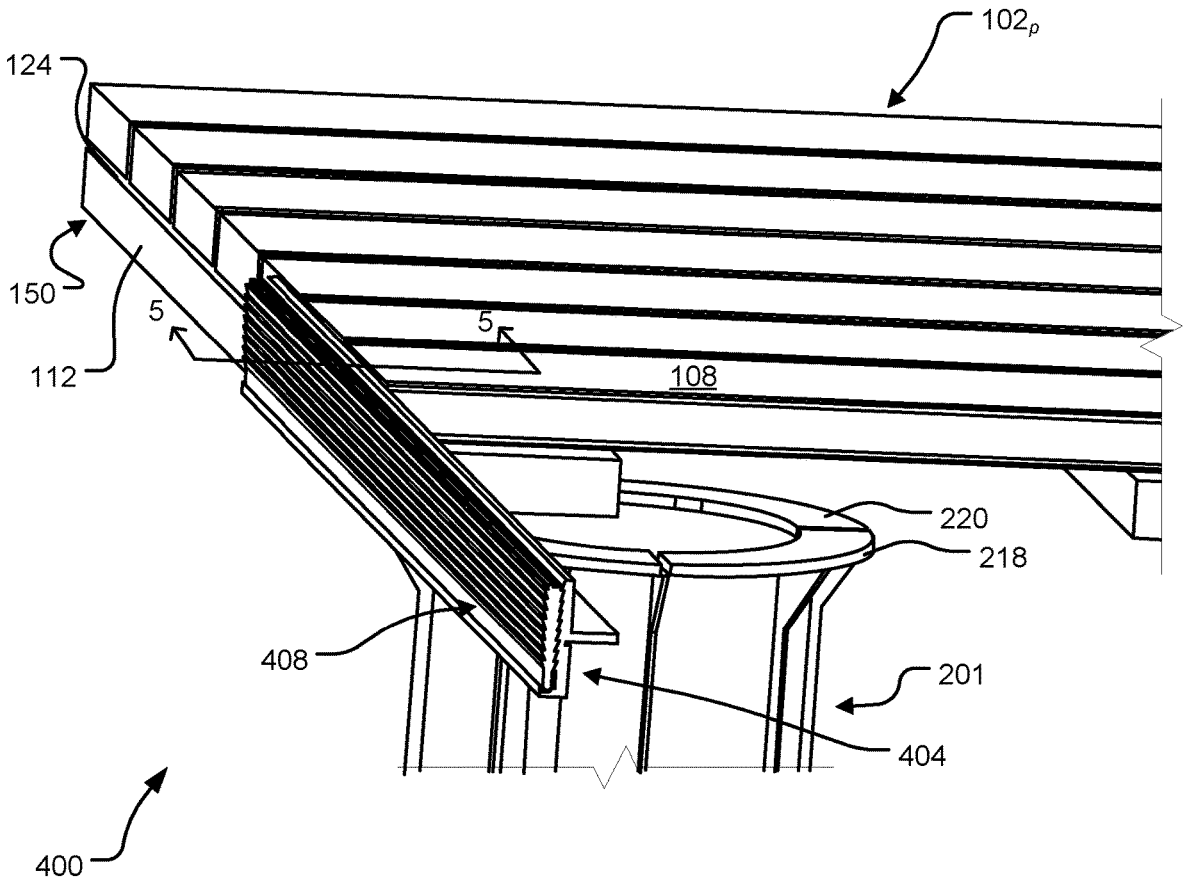
FIG. 3 is a perspective view of a portion of the elevated building surface assembly of FIG. 1 and illustrating a restraint system for limiting movement of a flooring unit of the assembly away from a fixed surface.

Turning now to FIG. 2, a support pedestal 201 (e.g., one or more of support pedestals 201 of FIG. 1) for supporting building surface components (e.g., flooring units 102 of FIG. 1) of an elevated building surface assembly (e.g., elevated building surface assembly 100 of FIG. 1) according to one embodiment is shown. Broadly, the support pedestal 201 may include a lower portion such as a base member 212 including a base plate 215 that is configured to be placed against a fixed surface (e.g., fixed surface 103) and a base extension 214 connected to the base plate 215 in any appropriate manner and extending away from the base plate 215. The support pedestal 201 may also include an upper portion such as a support member 216 including a support plate 218 having an upper or top surface 220 over which flooring units 102 are configured to be placed and support extension 219 connected to the support plate 218 in any appropriate manner and extending away from the support plate 218.

In one arrangement, the base and support extensions 214, 219 may be threadably engageable with each other to allow the height of the support pedestals 201 (i.e., the distance between the base and support plates 215, 218) to be adjusted. For instance, the base extension 214 may be in the form of a hollow cylindrical member having a threaded inner surface and the support extension 219 may be in the form of a cylindrical member having a threaded outer surface that is configured to be threadably received inside the base extension 214 (or vice versa). The base and support extensions 214, 219 may collectively form a "central section" of the support pedestal 201. In some arrangements, one or more coupling members may be incorporated between the base and support extensions 214, 219 to allow for increased heights of the support pedestal 201 (e.g., such as that disclosed in U.S. Pat. No. 8,156,694 which is incorporated herein by reference as if set forth in full). In other arrangements, the support pedestal 201 may have a fixed height, such as where the base and support plates 215, 218 are fixedly attached together by one or more rigid members that are not adjustable relative to each other.

As discussed previously, it may be desirable to resist movement of the flooring units 102 in a direction away from the support structure 200 and the fixed surface 103 that may otherwise be induced due to strong winds blowing across and/or under the flooring units 102, other disruptive events, and the like. In one arrangement, one or more elongate restraining members may be disposed along the outer edge segments of one or more of the flooring units 102 (e.g., of interior flooring units $\mathbf{102}_i$) for use in restricting such movement of the flooring units 102 away from the support pedestals 201. As one example, the elongate restraining members may be in the form of elongate channel members (e.g., elongate C-channel members) that are disposed along the outer edge segments 120 of one or more pairs of abutting or adjacent flooring units 102. For instance, each elongate channel member may include a restraint portion that is disposed over a portion of a flooring unit 102 along its outer edge segment 120 (e.g., over its top surface 108, within an elongated opening in the outer edge segment 120, etc.) and a mounting portion that is secured or affixed to one or more support pedestals 201 over which the flooring units 102 are laid. In one embodiment, the elongate channel members may be one or more of those disclosed in U.S. Pat. No. 9,038,324, assigned to the assignee of the present application, and which is incorporated herein by reference in its entirety.

As another example, the elongate restraining members 350 may be in the form of one or more elongate restraint splines that may be received in elongate openings (e.g., slots) that extend along the outer edge segments 120 of adjacent flooring units 102, where the elongate restraint splines may be unattached to the support pedestals 201. For instance, the restraint splines and elongate openings may be similar to those disclosed in U.S. Patent App. Pub. No. 2015/0308126, assigned to the assignee of the present application, and which is incorporated herein by reference in its entirety. As a further example, one or more tie-down devices (not shown) may be used to secure one or more of the corner portions 116 of the surface tiles to the support pedestals 201. For instance, the tie-down devices may include one or more of the anchoring washer and fastener arrangements disclosed in U.S. Pat. No. 8,302,356, assigned to the assignee of the present application, and which is incorporated herein by reference in its entirety.

In another arrangement, the elevated building surface assembly 100 may include one or more restraint systems 400 positionable between the outer periphery of the elevated building surface 101 and the wall 300 for resisting movement of the flooring units 102 in a direction away from the support structure 200 and the fixed surface 103 that may otherwise be induced due to strong winds blowing across and/or under the surface tiles 102, other disruptive events, and the like. With reference now to FIGS. 3-8, the restraint system 400 includes an anchoring member 404 disposable over the outer periphery 150 of the elevated building surface 101 (e.g., where the outer periphery 150 is collectively formed by outer edge segments 112 of peripheral surface tiles $\mathbf{102}_p$) and a wedging member 408 insertable between the anchoring member 404 and the wall 300 to frictionally grip the anchoring member 404 and wall 300 and thereby restrict movement of at least one of the peripheral flooring units $\mathbf{102}_p$ in a direction away from the fixed surface 103 and the support structure 200 (away from the support pedestals 201).

Broadly, the anchoring member 404 may be in the nature of any appropriate apparatus or device that provides a surface against which the wedging member 408 can be wedged to inhibit movement of the at least one peripheral flooring unit $\mathbf{102}_p$ away from the fixed surface 103 and support structure 200. As an example, the anchoring member 404 may include a base member 412 and an engagement component 416 that secures the base member 412 against movement relative to the at least one peripheral flooring unit $\mathbf{102}_p$ in a direction towards and away from the fixed surface 103. The base member 412 may include a body 420 of any appropriate material (e.g., plastic, metal, etc.) having a first surface 424 that is configured to be engaged by the wedging member 408 and an opposite second surface 428 that is configured to face the outer periphery 150 of the elevated flooring surface 101 (e.g., the outer edge segment 112 of the at least one peripheral surface tile $\mathbf{102}_p$).

For instance, the first surface 424 may include any appropriate gripping component thereon such as a plurality of teeth as illustrated (not labeled, e.g., where such teeth generally extend in a direction parallel to a length of the outer periphery 150), a knurled surface, adhesives, and/or the like. In one arrangement, the body 420 may be in the nature of an elongated member that is configured to extend along a length of the outer periphery 150 so that the first surface 424 provides a large area that can be engaged by the wedging member 408 to provide increased resistance against upward movement of the at least one peripheral surface tile $\mathbf{102}_p$.

Figure 4:
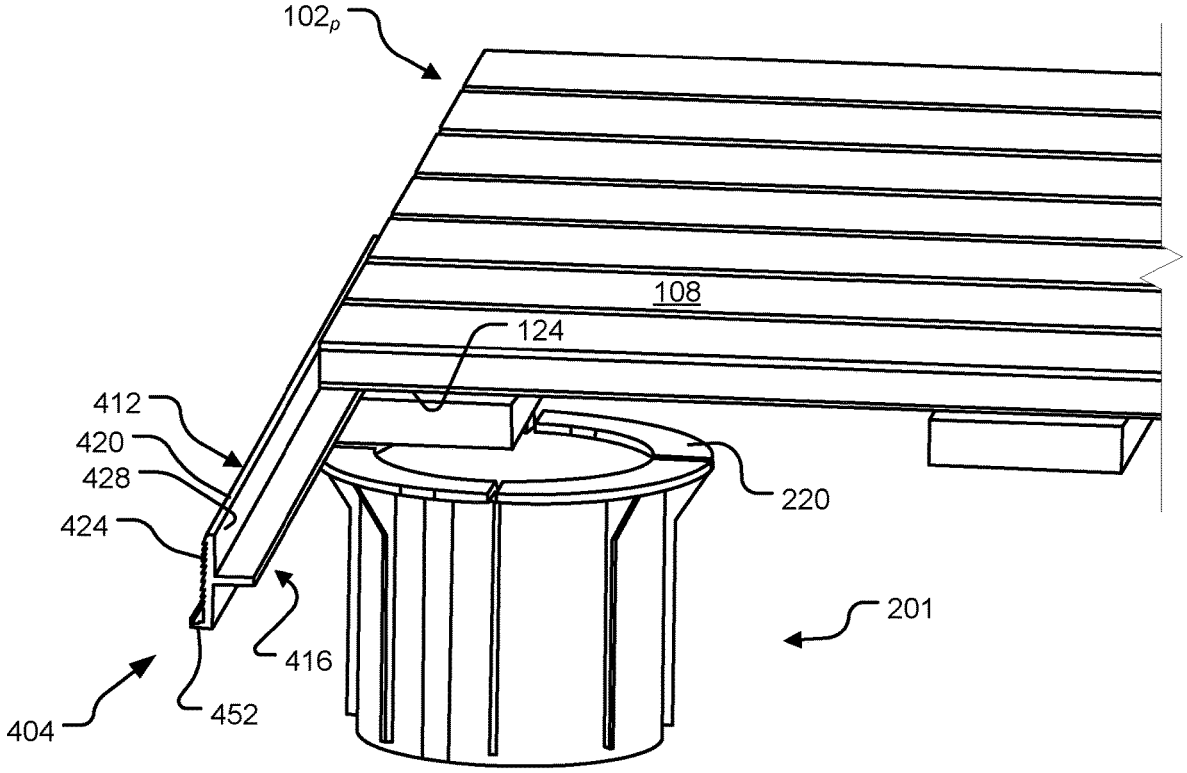
FIG. 4 is another perspective view similar to FIG. 3 but with a wedging member of the restraint system removed.
Figure 5A:
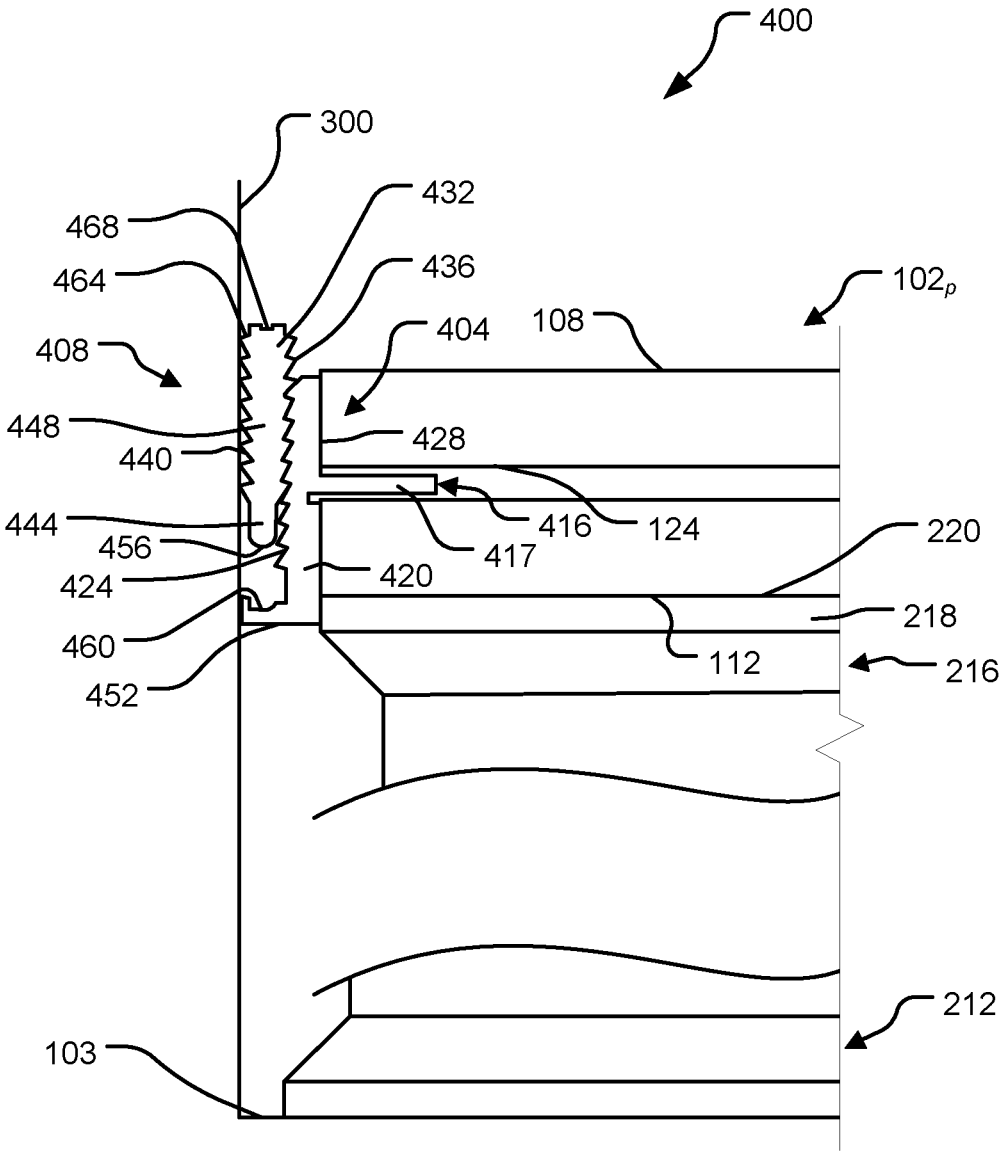
FIG. 5*a* is a sectional view of a portion of the assembly of FIG. 3 with the wedging member being in a first position.
Figure 5B:
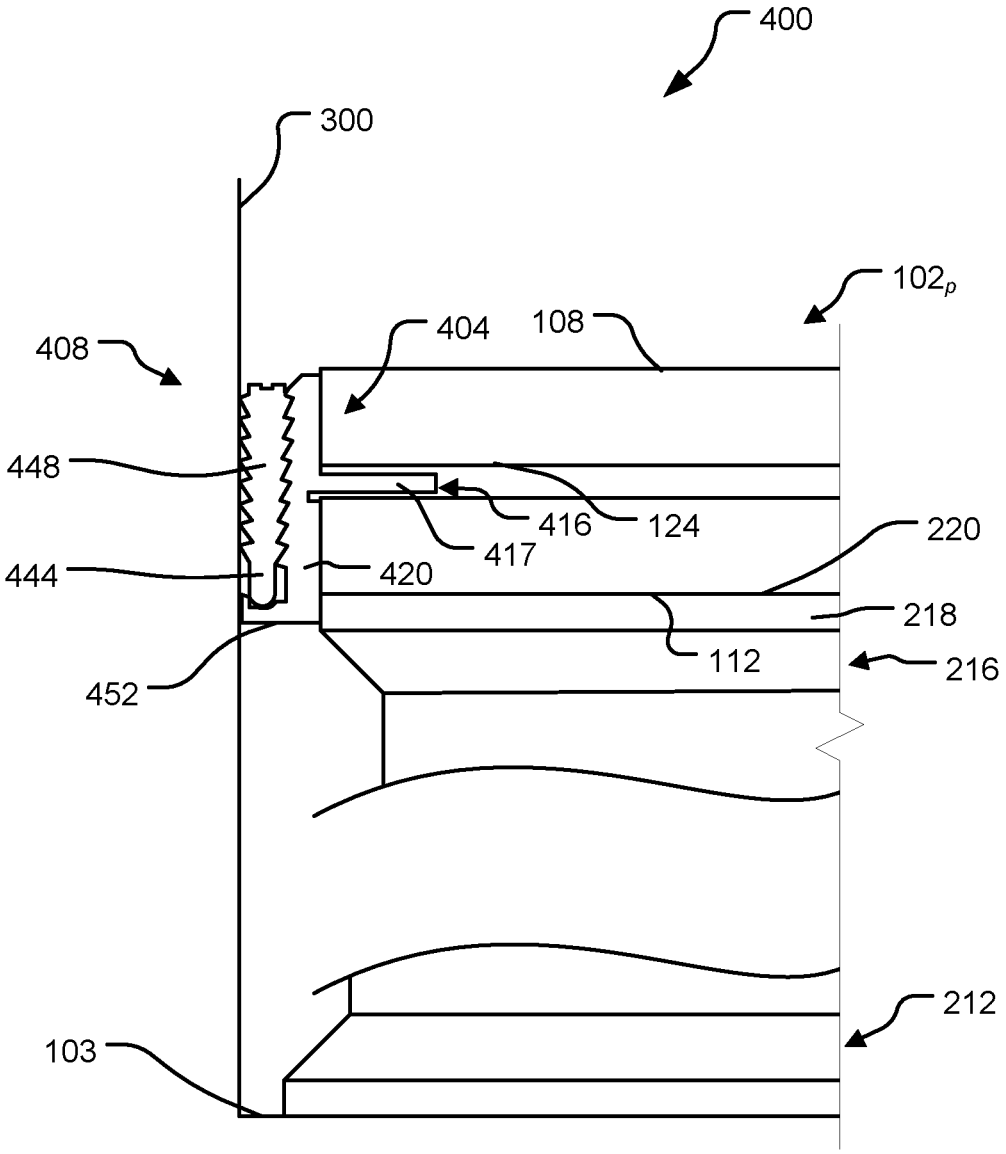
FIG. 5*b* is a sectional view of a portion of the assembly of FIG. 3 with the wedging member being in a second position.
Figure 6A:
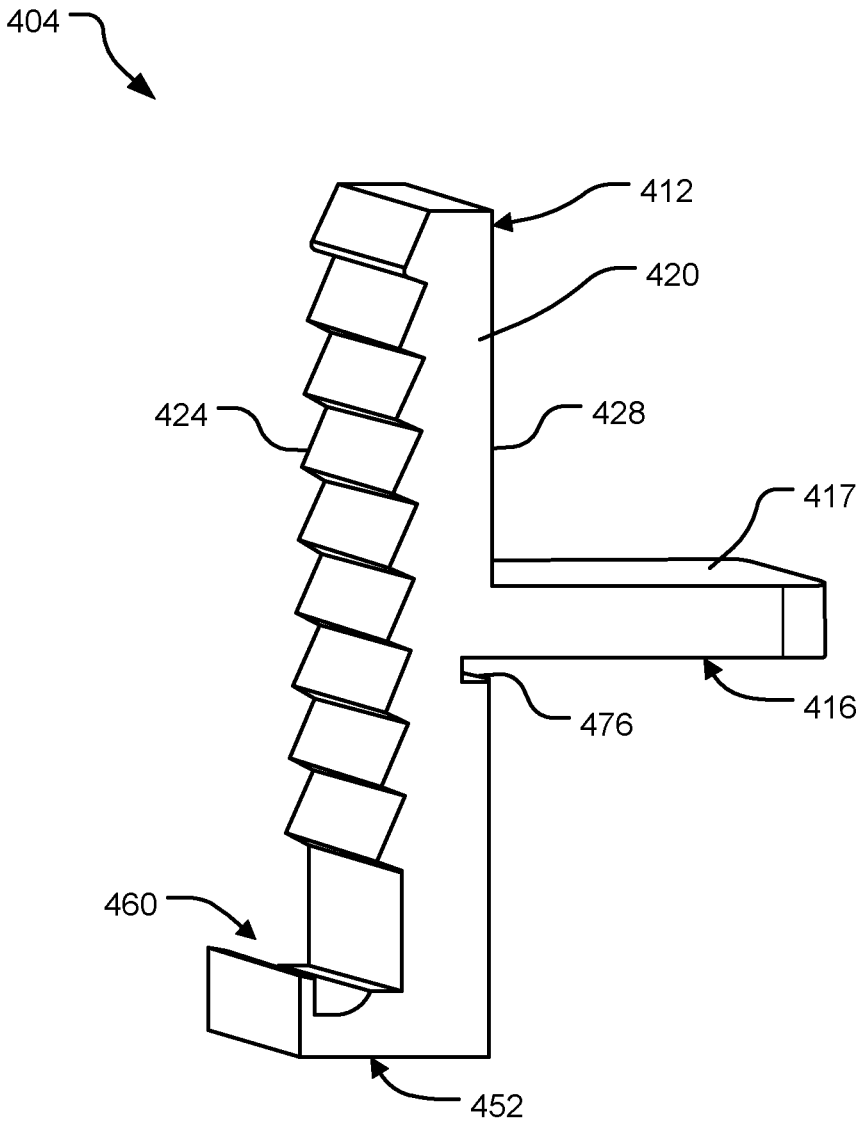
FIG. 6*a* is perspective view of a portion of an anchoring member of the restraint system.
Figure 6B:
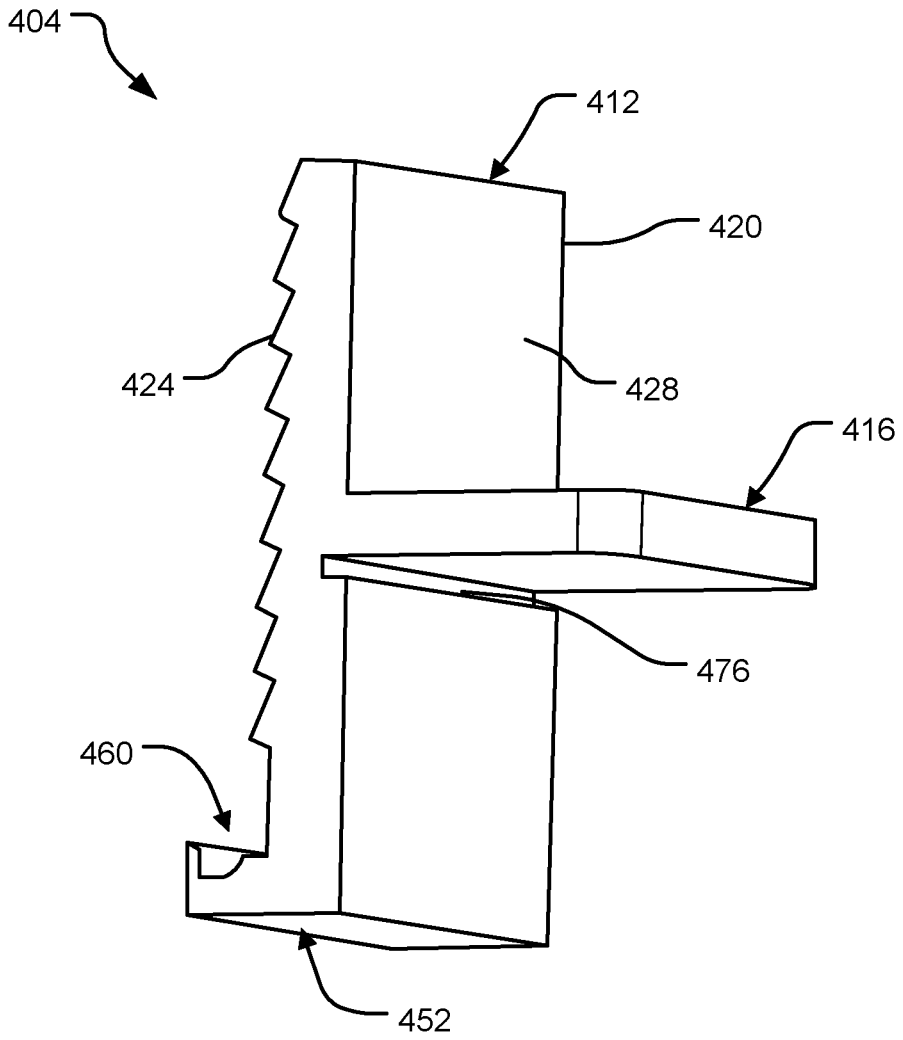
FIG. 6*b* is another perspective view of a portion of the anchoring member of the restraint system.
Figure 7:
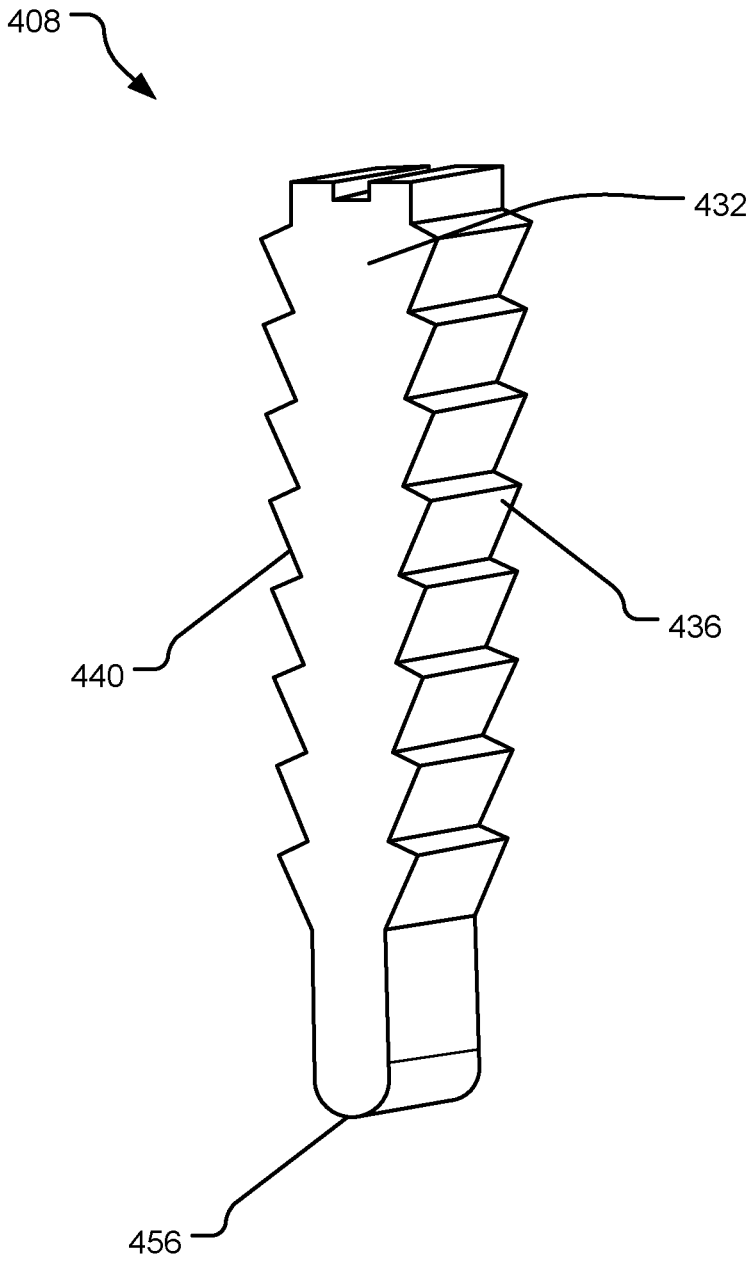
FIG. 7 is a perspective view of a portion of the wedging member of the restraint system.
Figure 8:
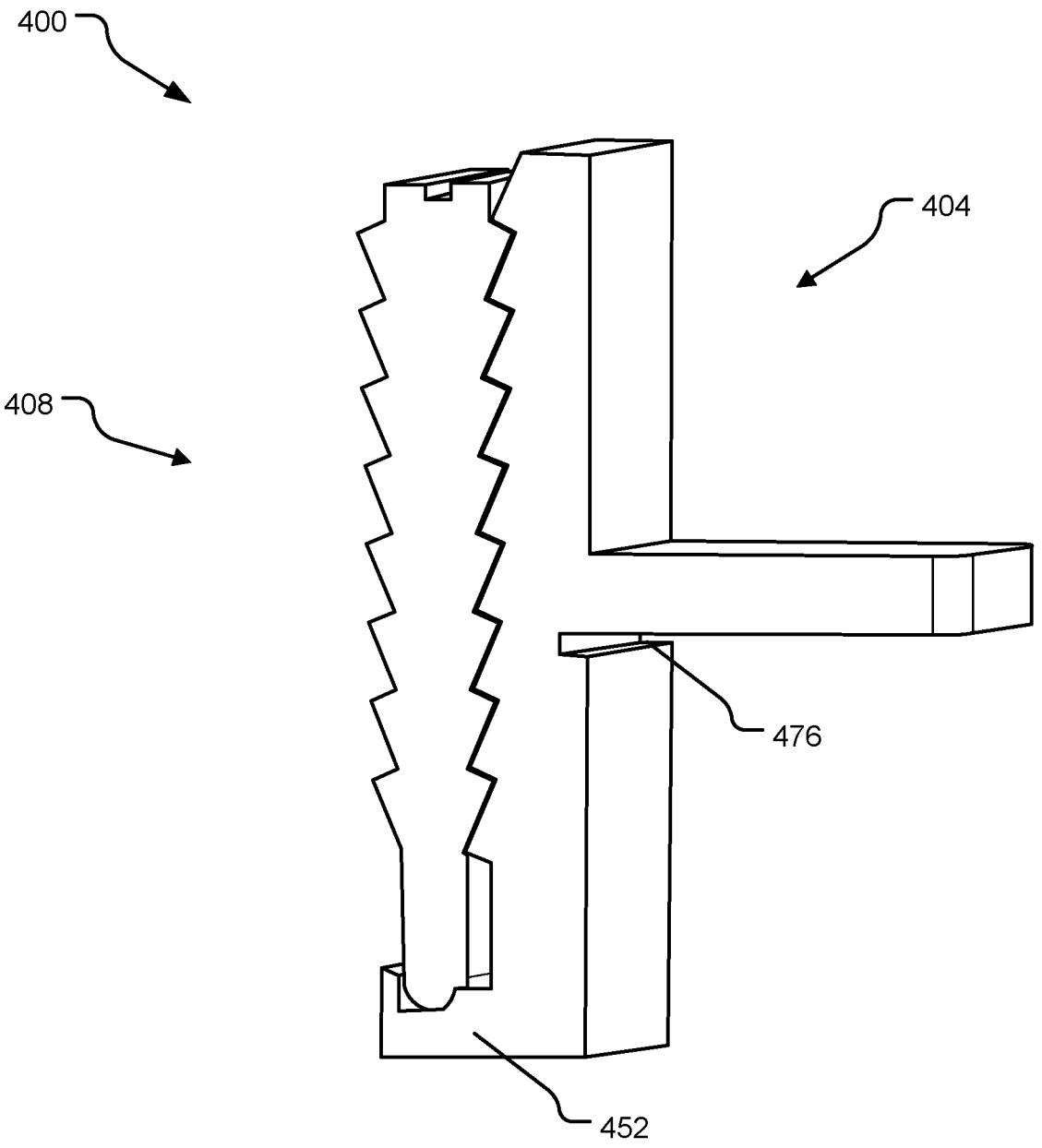
FIG. 8 is a perspective view of a portion of the wedging member being engaged with the anchoring member.

As shown, the engagement component 416 may be in the nature of a mechanical member having a body 417 that protrudes away from the second surface 428 of the body 420 of the base member 412 and that is configured to be received in an opening 124 in the outer periphery 150 of the elevated flooring surface 101. As an example, the engagement component 416 may be in the form of an elongated spline and the opening 124 may be in the form of an elongated slot (e.g., kerf) that is configured to receive the spline. For instance, a height or thickness of the opening 124 may be selected to be about the same as or slightly greater than a thickness of the spline so that when the spline is received in the slot as illustrated in FIGS. 4, 5*a*, and 5*b*, the anchoring member 404 is generally limited from movement relative to the at least one peripheral flooring unit $\mathbf{102}_p$ in directions towards or away from the fixed surface 103. Additionally or alternatively, the engagement component 416 may take other forms such as adhesives (e.g., where such adhesives could be applied over the second surface 428 of the body 420), one or more fasteners (e.g., bolts, screws) that are configured to be received in corresponding openings in the outer periphery 150, and/or the like.

The wedging member 408 may broadly be in the nature of a body 432 of any appropriate material that is configured to be wedged between the wall 300 and the anchoring member 404 to inhibit movement of the at least one peripheral flooring unit $\mathbf{102}_p$ away from the fixed surface 103 and the support structure 200. For instance, the body 432 of the wedging member 408 may include a first surface 436 that is configured to contact the first surface 424 of the body 420 of the anchoring member 404 and an opposite second surface 440 that is configured to contact the wall 300. In one arrangement, the first surface 436 may include a gripping component that is configured to inhibit movement of the wedging member 408 relative to the base member in a direction towards or away from the fixed surface 103. As one example, the gripping component of the first surface 436 may be complimentary to that of the first surface 424 of the body 420 of the anchoring member 404 (e.g., a series of teeth that are configured to engage with corresponding teeth on the first surface 424). Additionally or alternatively, the gripping component of the first surface 436 may include a knurled surface, adhesive(s), and/or the like. The second surface 440 of the body 432 of the wedging member 408 may also include a gripping component thereon (e.g., teeth, knurls, adhesive, and/or the like) that is configured to inhibit movement of the wedging member 408 relative to the wall 300 in a direction towards or away from the fixed surface 103.

In one embodiment, the body 432 of the wedging member 408 may be in the form of an elongated spline that is configured to be forcibly inserted or disposed (wedged) between the wall 300 and the anchoring member 404 to inhibit movement of the anchoring member 404 and thus the at least one peripheral surface tile $\mathbf{102}_p$ towards or away from the fixed surface 103 and support structure 200. For instance, the body 432 may include a lower portion 444 having a first thickness that facilitates initial insertion between the wall 300 and the anchoring member 404 and an upper portion 448 having a second thickness greater than the first thickness that facilitates frictional contact between a) the first surface 436 of the body 432 and the first surface 424 of the body 420 and b) the second surface 440 of the body 432 and the wall 300.

In one arrangement, the anchoring member 404 may include a stop member 452 that is configured to inhibit further movement of the wedging member 408 relative to the anchoring member 404 (and thus relative to the peripheral flooring unit $\mathbf{102}_p$) in a direction towards the fixed surface 103. For instance, the stop member 452 may be in the form of a projection (e.g., lip, etc.) that extends away from the first surface 424 of the body 420 towards the wall 300 (e.g., when the anchoring member 404 is attached to the at least one peripheral surface tile $\mathbf{102}_p$). In one embodiment, the stop member 452 may include a cavity 460 (e.g., depression, opening, etc.) therein that is configured to receive a first end 456 of the body 432 of the wedging member 408. An opposite second end 464 of the body 432 of the wedging member 408 may include an opening 468 (e.g., depression, slot, etc.) therein that is configured to receive a tool (e.g., screwdriver, etc.) for use in urging the wedging member 408 between the wall 300 and the anchoring member 408.

To facilitate the reader's understanding of how restraint systems 400 may be incorporated and used within an elevated building surface assembly 100 in a manner that restricts upward movement or lifting of flooring units 102 (e.g., in response to wind blowing underneath or across the flooring units 102), one method of constructing an elevated building surface assembly at a particular site of interest will now be discussed. The method may initially include locating a plurality of support apparatuses (e.g., such as support pedestals 201) upon a fixed surface (e.g., fixed surface 103) that is at least partially surrounded by a wall (e.g., wall 300). See FIG. 1.

The method may then include placing flooring units (e.g., flooring units 102) over the upper surfaces of the support members of the support pedestals to create an elevated building surface of the building surface assembly, where the flooring units include interior flooring units (e.g. flooring units $\mathbf{102}_i$) and peripheral flooring units (e.g., flooring units $\mathbf{102}_p$) disposed between the interior flooring units and the wall, and where outer edge segments of the peripheral flooring units collectively form an outer periphery of the elevated building surface (e.g., outer periphery 150). Before or after the peripheral surface tiles are disposed over the support pedestals, one or more anchoring members (e.g., anchoring members 404) may be attached over and/or along the outer edge segments of the peripheral flooring units (i.e., over the outer edge segments that collectively form the outer periphery of the elevated building surface) such that the anchoring members are non-movable relative to the peripheral flooring units in a direction towards or away from the fixed surface. For instance, engagement components (e.g., engagement components 416) may be inserted into openings 124 in the outer periphery 150. See FIGS. 3, 4, 5*a*, and 5*b*.

In any case, the method may also include wedging a restraint member between the wall and an outer periphery of the flooring surface to restrict movement of the peripheral flooring units in a direction away from the fixed surface. More specifically, the wedging may include contacting the anchoring member with a first surface of the restraint member and contacting the wall with an opposite second surface of the restraint member. For instance, FIG. 5*a* illustrates the wedging member 408 after it has been partially inserted into a gap between the wall 300 and the first surface 424 of the body 420 of the anchoring member 404 while FIG. 5*b* illustrates the wedging member 408 after being urged further within the gap to a different position between the wall 300 and the first surface 424. In one arrangement, the wedging member 408 may be urged until the first end 456 makes contact with the stop member 452 or is otherwise received in the cavity 460. Additionally or alternatively, the wedging member 408 may be urged until the second end 460 is disposed at or below the upper surface 108 of the one or more peripheral flooring units $\mathbf{102}_p$. In any case, it may be appreciated how further urging of the wedging member 408 into the gap (e.g., via ratcheting the wedging member 408 along the teeth on the first surface 424 of the anchoring member 404) creates more contact between the first and second surfaces 436, 440 and the first surface 424 of the anchoring member 404 and the wall 300, respectively, and thus increasing levels of resistance to upward movement of the peripheral flooring units $\mathbf{102}_p$ away from the fixed surface.

Figure 9:
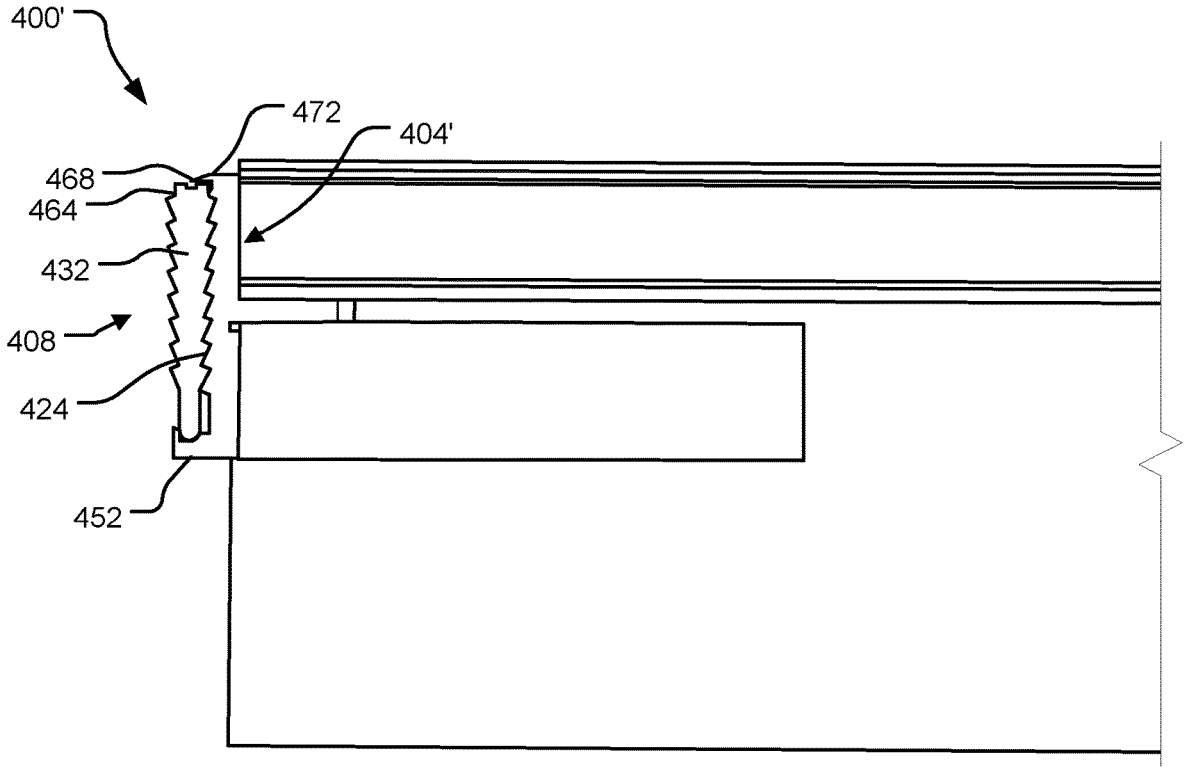
FIG. 9 is a side view similar to FIG. 5*b* but according to a different embodiment.

FIG. 9 illustrates another embodiment of the restraint system 400', where the anchoring member 404' includes a latching member 472 protruding away from the first surface 424 of the anchoring member 404' for use in capturing the body 432 of the wedging member 408 between the latching member 472 and the stop member 452 and thereby inhibiting unintentional removal of the wedging member 408 from the gap between the wall 300 and the anchoring member 408. For instance, the latching member 472 may be in the form of a resilient arm, protrusion, ledge, or the like that is configured to flex when the wedging member 432 is being passed between the wall 300 and the anchoring member 408 and then return to its original position after the second end 464 of the wedging member 408 has passed thereby. In one arrangement, the latching member 472 may include a free end (not labeled) that is configured to be received in the opening 468 of the wedging member 408.

Figure 10:
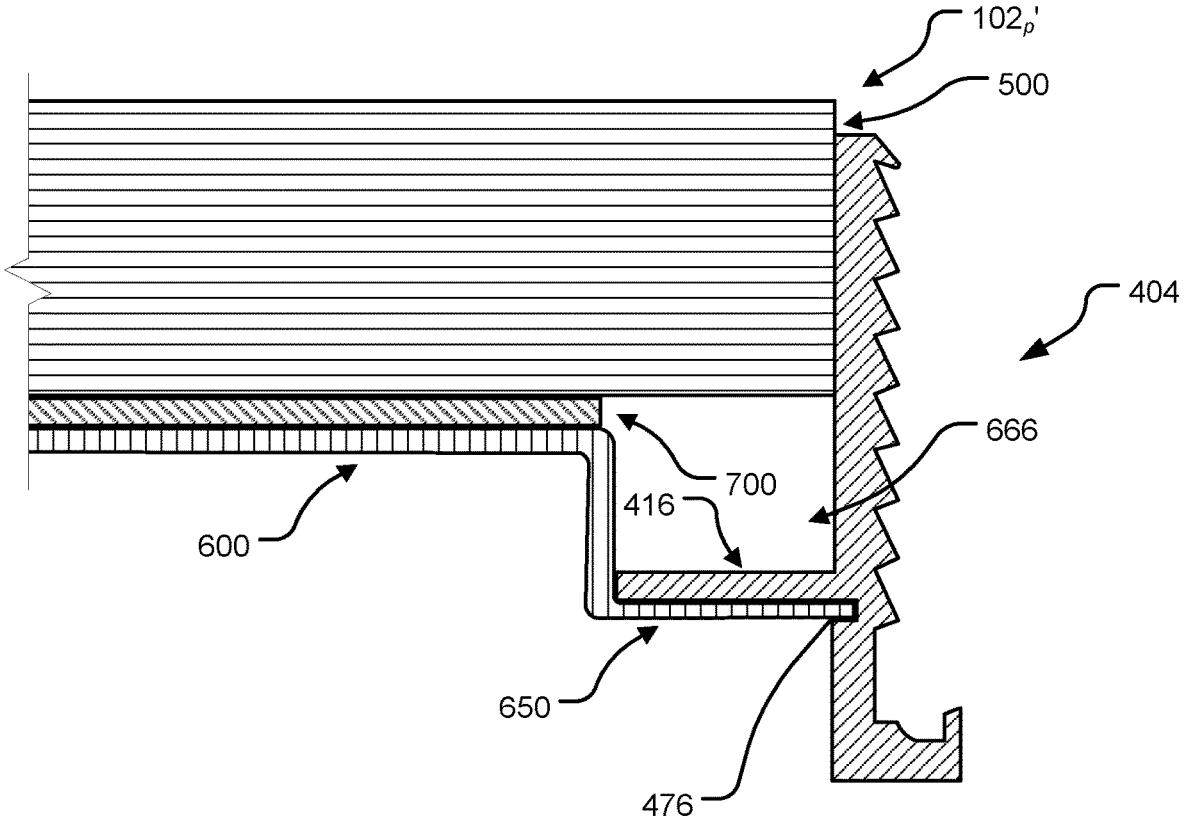
FIG. 10 is a side view of the anchoring member being attached to another type of flooring unit of the elevated building surface assembly, according to another embodiment.

FIGS. 9-10 illustrate another use of the anchoring members 404, 404' in conjunction with a different type of peripheral flooring unit $\mathbf{102}_p$'. Specifically, the peripheral flooring unit $\mathbf{102}_p$' may include a surface tile 500 and a support plate 600 that is configured to provide additional support for the surface tile 500. For instance, the bottom surface (not labeled) of the building surface component 500 may be secured to the top surface (not labeled) of the support plate 600 with any appropriate adhesive(s) 700. In one arrangement, the flooring units 102' (including building surface components and support plates) may be the same as those disclosed in U.S. Patent Application No. 62/581,141, which is assigned to the Assignee of the present application, and which is incorporated herein by reference in its entirety as if set forth in full.

Figure 11:
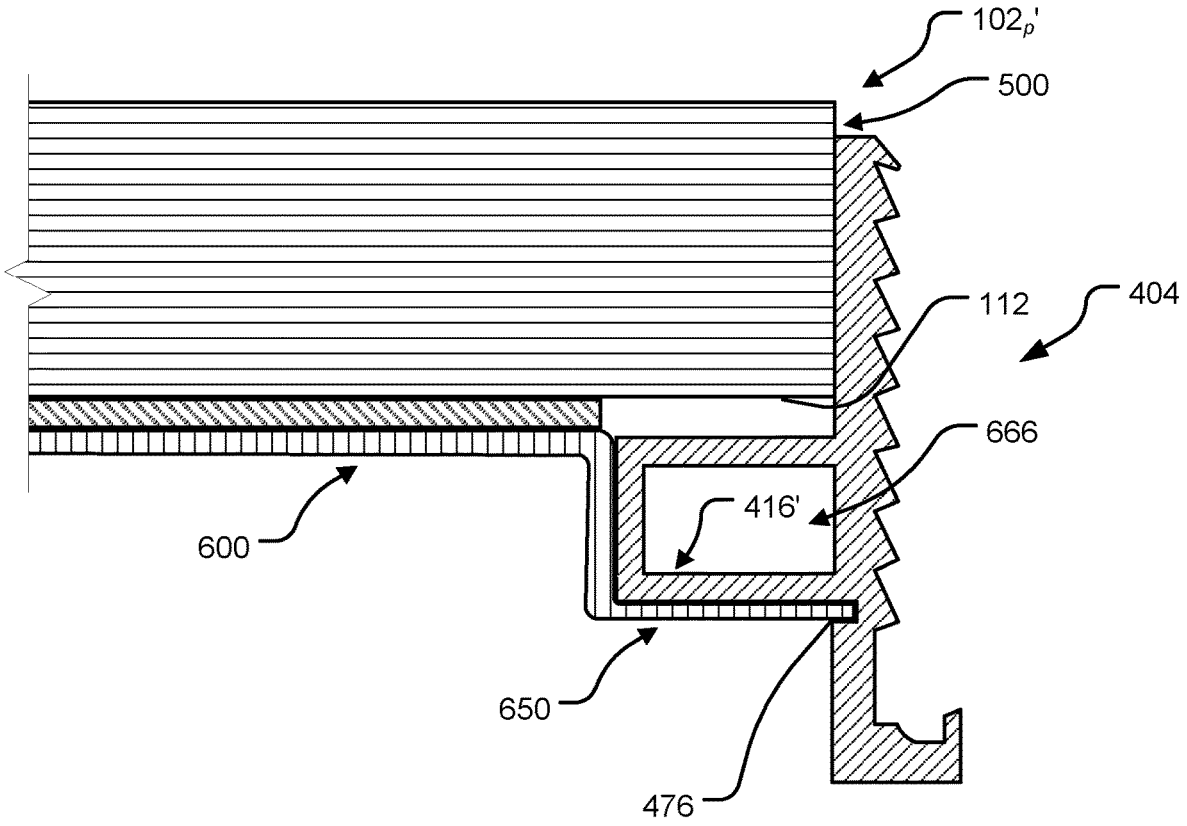
FIG. 11 is an alternative embodiment of FIG. 10.

As shown, the support plate 600 may include an attachment member 650 that is configured to facilitate placement of the flooring unit 102' over the upper surface of a support apparatus such as the upper surface 220 of a support pedestal 201. When the building surface component 500 is selected to have a width or cross-dimension that extends over the attachment member 650, this arrangement advantageously creates a gap 666 (e.g., slot, elongated opening, etc.) between the bottom surface of the building surface component 500 and the top surface (not labeled) of the attachment member 650 into which the engagement component 416 of the anchoring member 404 may be inserted for use in attaching the anchoring member 404 to the flooring unit 102'. In any case, the engagement component 416 may be disposed over the top surface of the attachment member 650. In one arrangement, any appropriate adhesive(s) may be disposed between the engagement component 416 and the attachment member 650 for use in inhibiting relative movement between the anchoring member 404 and the support plate 600 (and thus the flooring unit 102' as a whole). In one arrangement, the anchoring member 404 may include an opening (e.g., slot) 476 within the second surface 428 that is configured to receive a portion of the attachment member 650 of the support plate 600 for use in further inhibiting relative movement between the anchoring member 404 and the support plate 600 (and thus the flooring unit 102' as a whole). Also see FIGS. 6*a*, 6*b*, and 8. FIG. 11 presents an alternative embodiment of FIG. 10 in which the engagement component 416' is in the form of a hollow member that is configured to substantially fill the gap 666 between the bottom surface 112 and the attachment member 650 and thereby increase the support of the building surface component 500. While the engagement component 416' is not illustrated as being in contact with the bottom surface 112, the engagement component 416' may actually be in contact with the bottom surface 112 in some arrangements. Furthermore, the engagement component 416' may in other embodiments be a solid member.

The restraint system 400 disclosed herein may be constructed of any appropriate materials consistent with the functionalities disclosed herein such as wood, plastics, metals, reinforced composites, ceramic, glass, fiberglass, or combinations thereof. In one embodiment, the peripheral flooring units $\mathbf{102}_p$ may be loosely laid over the support structure 200 (e.g., over the support pedestals 201) or in other words not rigidly attached to the support structure. In one arrangement, adjacent flooring units 102 may be interconnected in any appropriate manner. For instance, one or more elongate restraint splines may be received in elongate openings (e.g., slots) that extend along the outer edge segments 120 of adjacent flooring units 102. In the case where an elongate restraint spline extended through openings in abutting interior flooring units $\mathbf{102}_i$ and then through openings in adjacent abutting peripheral flooring units $\mathbf{102}_p$ (e.g., so that the abutting interior flooring units $\mathbf{102}_i$ were interconnected to the abutting peripheral flooring units $\mathbf{102}_p$) the restraint system 400 may thus also serve to restrict or reduce movement of such abutting interior flooring units $\mathbf{102}_i$ in an upward direction away from the support structure 200. For instance, the restraint splines and elongate openings may be similar to those disclosed in U.S. Patent App. Pub. No. 2015/0308126, assigned to the assignee of the present application, and which is incorporated herein by reference in its entirety.

It is to be understood that the various components disclosed herein have not necessarily been drawn to scale. Furthermore, the various components disclosed herein may be fabricated in any appropriate manner such as printing, molding, and/or the like. Still further, various additions and modifications can be made to the embodiments disclosed herein without departing from the scope of the present disclosure. In one arrangement, the first surface 424 of the body 420 of the anchoring member 404 may taper inwardly starting at the top of the body 420 and continuing towards the stop member 452 so as to increase the wedging effect of the wedging member 408 between the wall 300 and the anchoring member. In one arrangement, a second anchoring member may be secured to the wall 300 across from the anchoring member 404 so that the wedging member 408 is inserted between and makes contact with the first and second anchoring members. For instance, the second anchoring member may include a first surface (facing the first surface 424 of the first anchoring member 404) that includes a gripping component or structure (e.g., series of teeth, etc.) for use in engaging the second surface 440 of the wedging member 408.

Various combinations of the embodiments and arrangements disclosed herein are envisioned and encompassed within the scope of the present disclosure. While various embodiments of the present invention have been described in detail, it is apparent that modifications and adaptations of those embodiments will occur to those skilled in the art. However, is to be expressly understood that such modifications and adaptations are within the spirit and scope of the present invention.

What is claimed is:

1. An elevated flooring surface assembly, comprising: a plurality of support apparatuses spacedly disposed upon a fixed surface; a plurality of building surface components disposed over upper surfaces of the support apparatuses to create an elevated flooring surface, wherein the building surface components include interior building surface components and peripheral building surface components disposable between the interior building surface components and a wall, and wherein outer edge segments of the peripheral building surface components collectively form an outer periphery of the elevated flooring surface assembly; a restraint system positioned between the outer periphery of the elevated flooring surface assembly and the wall, wherein the restraint system includes: an anchoring member disposed over the outer periphery, the anchoring member including a body and a stop member, the stop member projecting away from the body toward the wall to define a gap between the body and the wall; and a wedge member inserted within the gap between the body of the anchoring member and the wall to frictionally grip the anchoring member and wall and thereby restrict movement of at least one of the peripheral building surface components in a direction away from the fixed surface.

2. The assembly of claim 1, wherein the anchoring member includes:

a base member; and an engagement component that secures the base member against movement relative to the at least one peripheral building surface component.

3. The assembly of claim 1, wherein the body has first and second opposite surfaces, wherein the first surface is configured to contact the wedge member, and wherein the second surface is configured to contact the outer periphery.

4. The assembly of claim 1, wherein the stop member is configured to contact the wall to define the gap.

5. The assembly of claim 1, wherein the stop member includes a cavity therein that is configured to receive a portion of the wedge member.

6. The assembly of claim 3, wherein the first surface includes a gripping component that is configured to inhibit movement of the wedge member relative to the anchoring member.

7. The assembly of claim 2, wherein the engagement component includes an adhesive.

8. The assembly of claim 2, wherein the engagement component includes a mechanical member.

9. The assembly of claim 8, wherein the at least one peripheral building surface component includes an opening therein that receives the mechanical member.

10. The assembly of claim 9, wherein the opening is a slot that runs along a length of an outer edge surface of the at least one peripheral building surface component.

11. The assembly of claim 1, wherein the wedge member includes a body having first and second opposite surfaces, wherein the first surface is configured to contact the base member and the second surface is configured to contact the wall.

12. The assembly of claim 11, wherein the first surface includes a gripping component that is configured to inhibit movement of the wedge member relative to the anchoring member.

13. A method of stabilizing a flooring surface that is elevated over a fixed surface by a support structure adjacent a wall extending from the fixed surface, the method comprising:

wedging a restraint member between the wall and an outer periphery of the flooring surface to restrict movement of the flooring surface in a direction away from the fixed surface, wherein the wedging of the restraint member includes:

disposing an anchoring member over the outer periphery, the anchoring member including a body and a stop member, and the stop member projecting away from the body toward the wall to define a gap between the body and the wall; and inserting a wedge member within the gap between the body of the anchoring member and the wall to frictionally grip the anchoring member and wall and thereby restrict movement of the flooring surface in a direction away from the fixed surface.

14. The method of claim 13, wherein the outer periphery of the flooring surface contacts a first surface of the restraint member and the wall contacts an opposite second surface of the restraint member.

15. The method of claim 13, wherein the anchoring member contacts the outer periphery of the flooring surface, the wall, and the wedge member.

16. The method of claim 13, wherein the anchoring member includes a base member and an engagement component that inhibits movement of the anchoring member relative to the flooring surface.

17. The method of claim 13, wherein stop member contacts the wall to define the gap.

18. The method of claim 13, wherein the stop member includes a cavity therein, and wherein the inserting a wedge member includes receiving the wedge member in the cavity of the stop member.

19. A method of constructing an elevated flooring surface, comprising:

locating a plurality of support pedestals upon a fixed surface that is at least partially surrounded by a wall, wherein each support pedestal includes a base member, a support member, and a central section interconnecting the base and support members, and wherein the support members each include an upper surface;

placing flooring units over the upper surfaces of the support members of the support pedestals to create the elevated flooring surface, wherein the flooring units include interior flooring units and peripheral flooring units disposed between the interior flooring units and the wall, wherein outer edge segments of the peripheral flooring units collectively form an outer periphery of the elevated flooring surface; and wedging a restraint member between the wall and an outer periphery of the flooring surface to restrict movement of the peripheral flooring units in a direction away from the fixed surface, wherein the wedging of the restraint member includes:

disposing anchoring members over the outer periphery, the anchoring members each including a body and a stop member, and the stop members projecting away from their respective bodies toward the wall to define gaps between the bodies and the wall; and inserting wedge members within the gaps between the bodies of the anchoring members and the wall to frictionally grip the anchoring members and wall and thereby restrict movement of the peripheral flooring units in a direction away from the fixed surface.

20. The method of claim 19, further including before the placing:

attaching the anchoring members to the outer edge segments of the peripheral flooring units that collectively form the outer periphery of the elevated flooring surface, wherein the inserting the wedge members includes contacting the anchoring members with a first surface of the wedge members and contacting the wall with an opposite second surface of the wedge members.

* * * * *